United States Patent [19]

Martenson

[11] Patent Number: 4,611,572

[45] Date of Patent: Sep. 16, 1986

[54] LOW EMISSION STOVE

[76] Inventor: Donald S. Martenson, 24430 S. Highway 99E, Canby, Oreg. 97013

[21] Appl. No.: 636,392

[22] Filed: Jul. 31, 1984

[51] Int. Cl.[4] ..... F24C 1/14

[52] U.S. Cl. ..... 126/77; 126/60; 126/83

[58] Field of Search ..... 126/77, 67, 65, 83, 126/76, 75, 60; 110/214, 210

[56] References Cited

U.S. PATENT DOCUMENTS

| | | | |
|---|---|---|---|
| 2,393,855 | 1/1946 | Cheasley | 126/77 |
| 3,808,986 | 5/1974 | Logdon | 110/210 |
| 4,111,181 | 9/1978 | Canney | 126/77 |
| 4,154,212 | 5/1979 | Wilkinson | 126/77 |
| 4,359,040 | 11/1982 | Martenson | 126/77 |
| 4,426,992 | 1/1984 | Martenson | 126/77 |
| 4,432,335 | 2/1984 | Kilham | 126/297 |
| 4,461,273 | 7/1984 | Barker et al. | 126/83 |

*Primary Examiner*—James C. Yeung
*Attorney, Agent, or Firm*—Klarquist, Sparkman, Campbell, Leigh & Whinston

[57] ABSTRACT

A low emission stove includes a firebox divided by an inverted baffle into a large lower primary combustion chamber, in which the solid fuel is placed, and a substantially smaller upper secondary combustion chamber. A restrictive vertical passage formed between a sidewall of the firebox and a downturned free end portion of the baffle connects the two chambers to convey combustion products produced in the lower chamber to the upper chamber before exiting from the stove. The air for the primary combustion in the lower chamber is drawn from beneath the firebox and directed upward to the firebox. The air enters the primary chamber through air inlets on multiple sides of the primary chamber, both at the fuel level and substantially above the fuel level. The combustion products produced are temporarily trapped within the primary chamber by the downturned free end portion of the baffles. A secondary air inlet near the vertical passage supplies air for secondary combustion of the combustion products within the secondary chamber, which is heated by the inverted baffle. A plurality of deflective baffles within the secondary chamber delays the passage of air and combustion products therethrough so that they may thoroughly burn before discharge from the stove.

15 Claims, 7 Drawing Figures

LOW EMISSION STOVE

BACKGROUND OF THE INVENTION

This invention relates generally to solid fuel-burning stoves and more particularly to stoves designed to minimize the emission of smoke from burning fuel into the atmosphere. The term "stove" as used herein is intended to define an enclosed apparatus that burns fuel to provide heat. The term thus encompasses fireplace inserts, boilers, basement furnaces, or the like, as well as the common free-standing stove.

Solid fuel-burning stoves, particularly wood stoves, have become popular in recent years as an inexpensive alternative for home heating. Until this surge of popularity, stoves were not a significant pollution source and their emissions were unregulated. But that has rapidly changed with the increased burning of wood and coal. Stoves have now become a major contributor to air pollution in urban areas. Present wood stoves release large amounts of combustion products such as particulate matter and smoke into the atmosphere.

In recognition of this growing problem, many jurisdictions have passed laws limiting the particulate emission from solid fuel-burning stoves. Missoula, Mont., for example, now monitors and limits particulate emissions from individual stoves because of the pollution they cause during the winter months. Oregon also has recently established emission standards for stoves and fireplace inserts effective in 1986 which specify a maximum number of grams of smoke emitted per hour of use.

Few of the stoves presently on the market can meet the existing and proposed regulations. In response to the Oregon standards, for example, most manufacturers have said that it would be difficult or impossible to meet them without expensive new technology such as a catalytic combustor, which acts as an afterburner to burn combustion products and absorb unburned particles. However, the addition of a catalytic combustor to a conventional stove dramatically increases its cost. The catalytic combustor itself will add $80–$100 to the cost of a new stove. Moreover, for the combustor to work effectively, the catalyst must be replaced regularly at an additional expense.

An alternative to the use of catalytic combustors is the use of secondary combustion chambers which subject the suspended particulate matter and combustible gases to continued or repeated combustion following primary burning of the fuel in a primary combustion chamber. Heretofore, several patents in the prior art have disclosed stoves which use a series of separate combustion chambers to burn fuel more efficiently and thus discharge less particulate matter from the stove. Many of these are primarily designed to achieve maximum burning efficiency. For example, my patents for a free-standing stove Ser. No. 06/403,484, recently allowed, and U.S. Pat. Nos. 4,359,040 and 4,426,992, disclose stoves that have a number of conduits and combustion chambers. Although these stoves effectively reduce particulate emission, their elaborate designs make them relatively expensive.

A simpler and less expensive design is disclosed in U.S. Pat. No. 4,411,181 to Canney. The patent describes a stove having a lower combustion chamber in which the wood is placed and a heating chamber above. Air is supplied beneath the wood for initial combustion. The rising combustion products encounter and flow along the bottom of a flat tube separating the two chambers and through a vertical opening into the heating chamber. Secondary outside air is drawn through the tube, heated, and mixed with the combustion products in the heating chamber to ignite them.

A similar design appears in U.S. Pat. No. 4,154,212 to Wilkinson. The stove has a combustion chamber or firebox for initially burning the fuel and a connected secondary heating chamber immediately above the firebox separated by a common wall. As illustrated in the figures, the combustion products produced within the lower combustion chamber rise directly through several spaced-apart openings in the common wall into the heating chamber where they are heated by the common wall and are immediately swept out of the chamber through the outlet.

Although these last-mentioned dual-chamber stoves offer an improvement over single-chamber stoves in more completely burning the fuel therein, they are lacking in several respects. First, the combustion products are drawn too quickly out of the initial combustion chamber, before initial combustion is completed. Second, too little combustion actually occurs in the second chamber. The relatively large second chamber cannot be sufficiently heated to ignite combustion products far from the common wall. Moreover, the openness of the chamber permits the combustion products to be drawn rapidly through it before they can be mixed with fresh air and re-ignited.

Other multichamber stoves partially overcome these drawbacks, but their complex designs increase their cost, giving them little advantage over catalytic combustors. Furthermore, none of these stoves has demonstrated that they can meet the stringent emission standards established by several governmental air pollution authorities.

It is therefore a primary object of the present invention to provide a solid fuel-burning stove which overcomes the aforementioned drawbacks and limitations of the prior art.

It is a further object of the invention to provide an inexpensive stove of simple design which meets proposed and existing emission standards without the use of a catalytic combustor.

It is yet another object to provide a low emission stove of great versatility in being adaptable for free-standing use, as a fireplace insert or with heat exchanger jackets for mobile home use.

SUMMARY OF THE INVENTION

The invention includes a stove with a firebox designed to minimize the emission of smoke when burning fuel. In one aspect of the invention, preheated combustion air may be injected into the firebox at approximately the level of fuel within the firebox. In a second aspect, a baffle may divide the firebox into a lower primary combustion chamber and an upper secondary combustion chamber for prolonging the combustion within the firebox. In a third aspect of the invention, outside air may be injected through multiple sidewalls of the firebox into the firebox at the fuel level. In still a fourth aspect, preheated conbustion air may be injected through the multiple sidewalls at any location.

A first embodiment discloses a firebox divided by an inverted baffle into a large lower primary combustion chamber, in which the fuel is placed, and a substantially smaller upper secondary combustion chamber. Primary combustion air is drawn upward from beneath the firebox and enters the primary chamber at fuel level through one sidewall and at a level above fuel level through multiple sidewalls. To prolong combustion within the primary chamber, the baffle is downturned at its free end portion to deflect combustion products downward and back into the primary chamber. The baffle also provides a heat source for combustion within the secondary combustion chamber by absorbing heat from combustion products temporarily trapped below it and radiating the heat into the second chamber. To promote secondary combustion, more combustion air may be mixed with the combustion products as they pass through a vertical passage between the baffle free end and a sidewall of the firebox before entering the secondary chamber. A plurality of upright deflective baffles is provided within the secondary chamber to prolong the passage of combustion products through the chamber so that they are thoroughly burned before discharge from the stove.

In a second embodiment, air inlets to the primary chamber are provided through multiple sidewalls both at fuel level and at a level substantially above fuel level. To further assist in trapping and recirculating the combustion products within the primary chamber, the downturned free end portion of the inverted baffle includes a reverse lip extending away from the vertical passage between upper and lower chambers.

The foregoing and other objects, features and advantages of the invention will become more readily apparent from the following detailed description which proceeds with reference to the accompanying drawings.

DETAILED DESCRIPTION

FIG. 1 Embodiment

Figure 1:
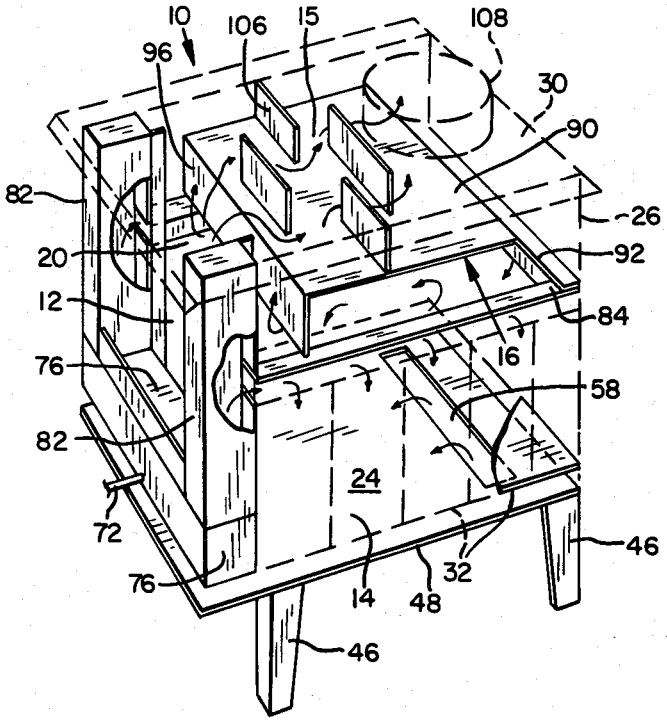
FIG. 1 is a perspective view of the stove showing its internal construction with exterior walls in phantom.
Figure 2:
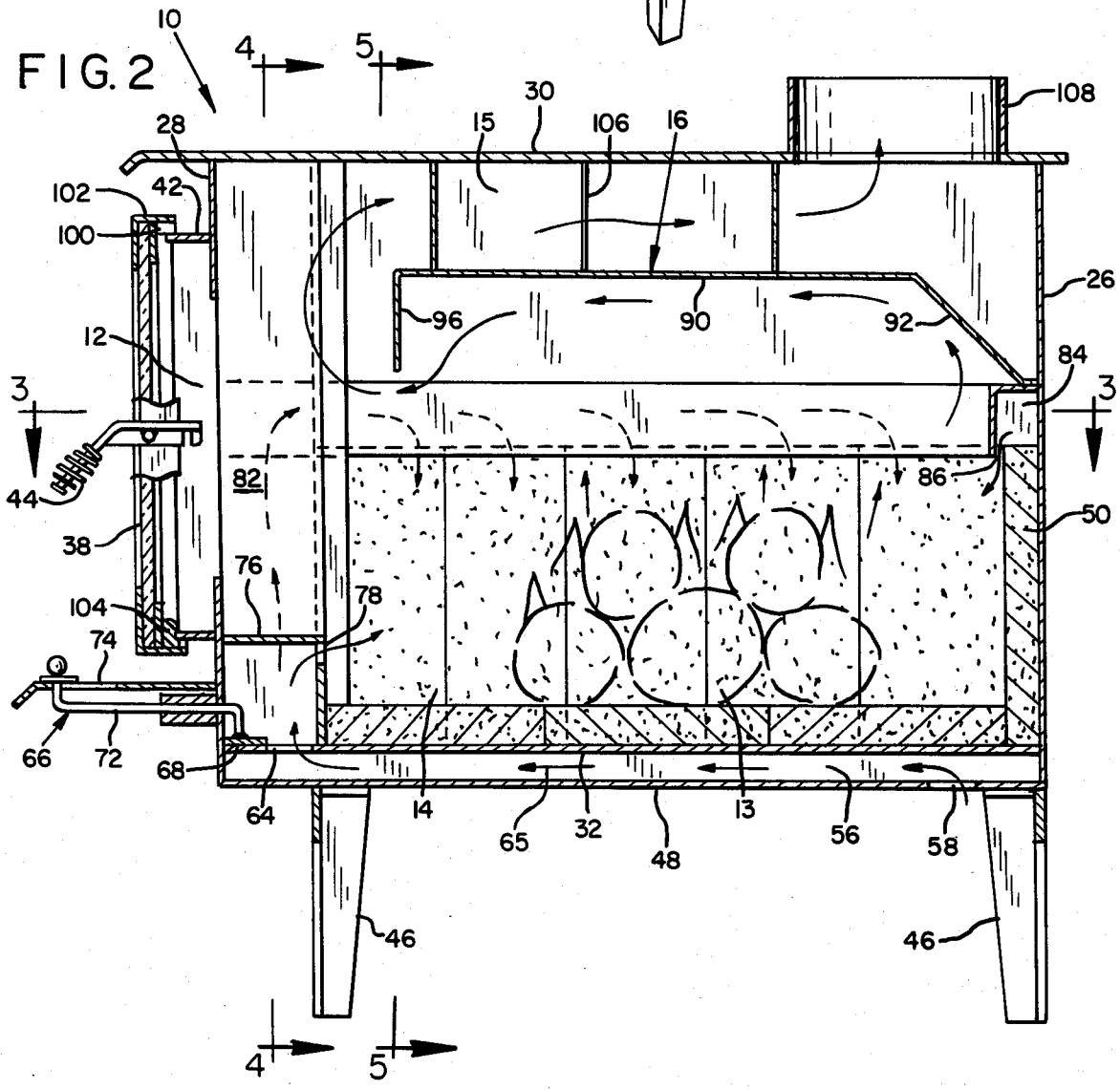
FIG. 2 is a vertical longitudinal sectional view of the stove of FIG. 1.

A solid fuel-burning stove 10 is illustrated in the following FIGS. 1-5. Referring generally to FIGS. 1 and 2, the stove 10 encloses a firebox 12 in which fuel 13, typically wood logs, is placed. The firebox 12 is divided into a lower primary combustion chamber 14 and an upper secondary combustion chamber 15 by a continuous baffle 16. A vertical passage 20 connecting the two chambers conveys combustion products, such as smoke and gases, produced in the initial combustion of the fuel from the lower chamber to the upper chamber. Primary air for the initial combustion is drawn into the primary chamber 14 through several air inlets. Secondary air is mixed with the combustion products near the vertical passage 20 to promote secondary combustion within the secondary chamber.

The firebox 12 is enclosed within the stove 10 by lateral, rear and front metal sidewalls 24, 26, and 28 and metal top and bottom walls 30, 32 (shown in phantom lines). The top and bottom walls are typically of a thicker gauge metal than the other walls to support cooking utensils and the fuel 13, respectively. The metal plates are welded together where they touch each other to form an airtight unit. The front wall 28 of the stove has an opening sealable by a metal hinged door 38 for allowing access to the firebox for placing the fuel 13 therein and for removing ash. The door mounts on an outwardly extending flange 42 bordering the opening and may be opened and closed by the use of a handle 44. A glass center area within the door allows for viewing the fire within. The stove 10 is supported by four angled metal legs 46, one at each corner of an outer bottom plate 48.

The primary combustion chamber 14 lies within the lower portion of the firebox 12 and is separated from the upper chamber 15 by the baffle 16, which is roughly parallel to but spaced below the top wall 30. Firebrick 50 lines the interior of the primary chamber 14 to reflect the heat generated within for more efficient combustion. The fuel 13 rests within the primary chamber 14 on the firebrick 50 above the bottom wall 32. If coal is to be primarily used as a fuel, a grate (not shown) should be positioned across the bottom wall 32.

Primary combustion air for the initial combustion of the fuel is supplied to the primary chamber 14 through a first air passage 56 underneath the firebox, formed between the bottom wall 32, the outer plate 48 and overlapping sidewalls 24. The air enters the passage 56 through an opening 58 in the outer plate 48 near the rear wall 26 and is drawn through the passage and into the primary chamber through a draft inlet 64 in the wall 32 near the front wall 28, as shown by the arrows 65 in FIG. 2. The passage 56 preheats the air before it enters the primary chamber 14 to increase the combustion within the chamber. The continuously moving air also insulates the underside of the stove from objects nearby.

A damper 66 controls the air flow from the passage 56 through the inlet 64 and into the primary chamber 14. The damper includes a cover plate 68 for covering the inlet 64 and a connected positioning bar 72 which extends out the front wall 28 of the stove 10 beneath the door 38. The cover plate 68 can be adjusted to cover all or a portion of the draft inlet 64 by moving the bar 72 in or out within a guide rail 74.

Figure 3:
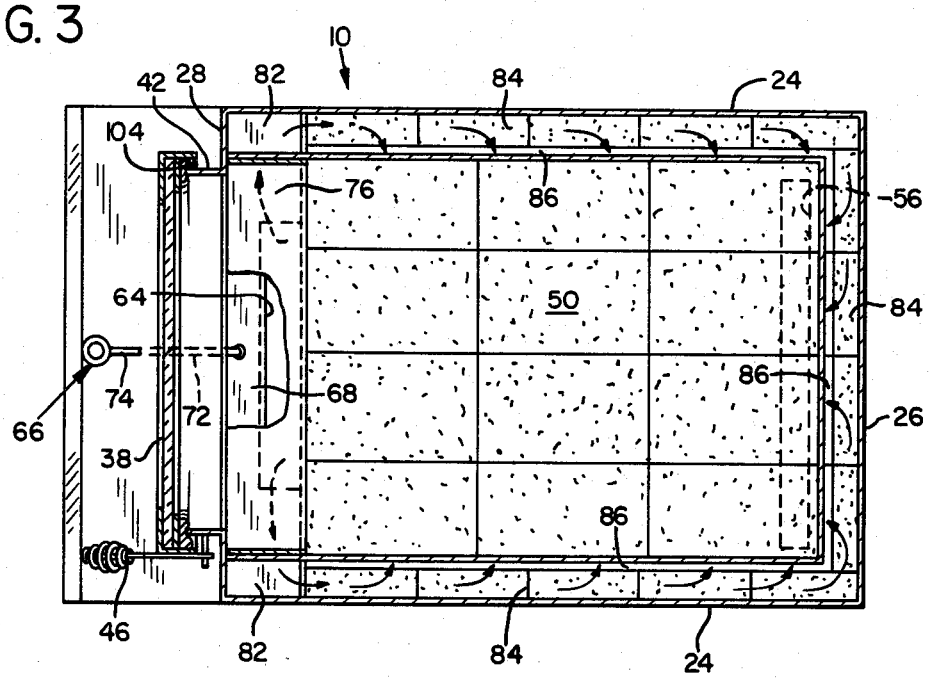
FIG. 3 is a horizontal sectional view taken along line 3—3 of FIG. 2.
Figure 4:
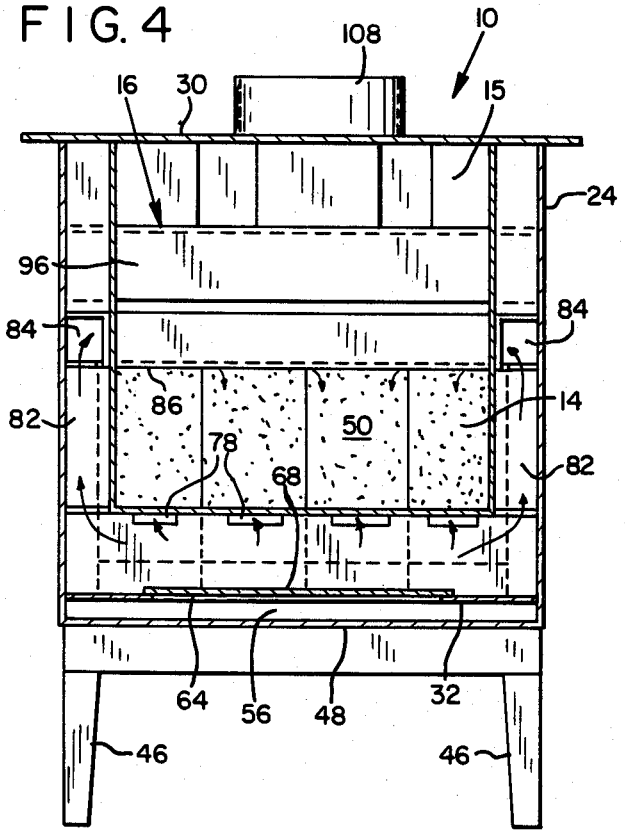
FIG. 4 is a vertical cross-sectional view taken along line 4—4 of FIG. 2.
Figure 5:
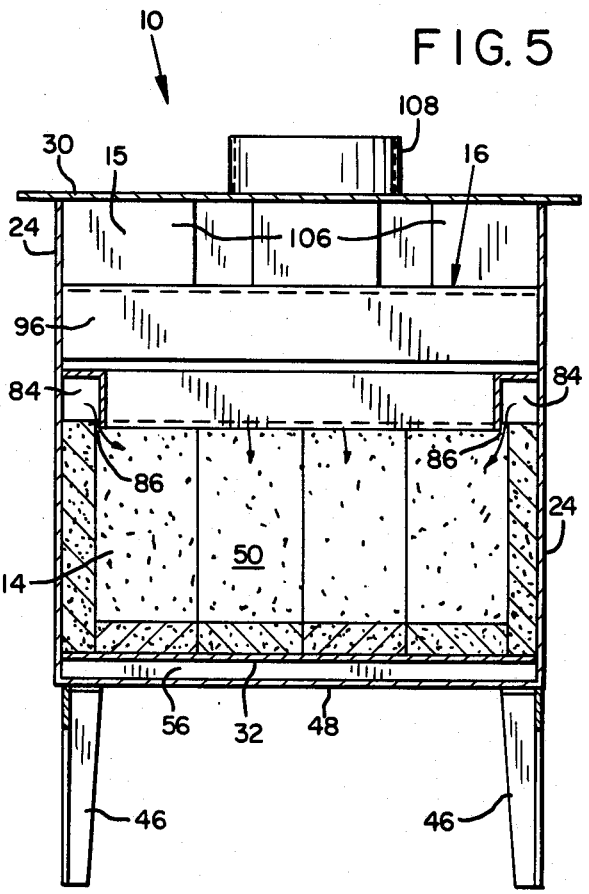
FIG. 5 is another vertical cross-sectional view taken along line 5—5 of FIG. 2.

Referring to FIGS. 3-5, which show part of the firebrick 50 removed for clarity, air from the draft inlet 64 enters the primary chamber 14 at several air inlet locations. A horizontal conduit 76 covering the inlet 64 extends the width of the primary chamber and forms a portion of a front sidewall of the chamber. Combustion air passing through the inlet 64 enters conduit 76 and is injected into the primary chamber at a height just below fuel level through a line of horizontal air inlets 78 running the conduit length, as seen in FIG. 4. This fuel level may be 3 to 4 inches, for example, if the fuel is wood logs. Thus, the air enters the primary chamber 14 across its width between sidewalls 24 to provide adequate oxygen for all the fuel within.

Primary combustion air also enters the primary chamber 14 from above the fuel level to prolong combustion of the fuel and combustion products produced from the initial fuel combustion. Referring to FIG. 1, a pair of vertical conduits 82 defining a second air passage extend upward from the horizontal conduit 76 along the interior of the lateral sidewalls 24. A portion of the preheated air passing through inlet 64 flows through these conduits 82 to a second horizontal air conduit 84 which extends along the lateral and rear sidewalls of the chamber 14 above the firebrick 50. The conduit 84 is formed by an inverted L-shaped railing extending horizontally inward above the firebrick and vertically downward to laterally overlap the brick 50. A gap between the firebrick and vertical portion of the rail form a second air inlet 86. As best seen in FIGS. 1, 3 and 5, conduit 84 directs the primary air into the chamber through the air inlet 86 to all sides of the primary chamber 14.

The inverted baffle 16 forms a continuous ceiling of the primary chamber and also the floor of the upper secondary combustion chamber 15. The baffle partitions the firebox interior into the large primary chamber 14 and substantially smaller secondary chamber 15 to slow the passage of the combustion products through the stove. Low emissions have been obtained with the volume of the primary chamber 14 at least three times that of the secondary combustion chamber 15.

The baffle joins the two lateral sidewalls 24 and extends from the rear wall 26 to a point short of the front wall 28 to form the vertical passage 20 between the chambers. To direct the combustion products in the desired direction, the baffle center portion 90 is generally horizontal, angling downward at a rear portion 92 to the top of the conduit 82 along the rear wall 26. At its forward edge, the baffle terminates sharply in a free end portion 96 extending downward. So formed, the baffle forces the rising combustion products to flow along the underside of the baffle from its rear portion 92 toward the downturned portion 96, as indicated by the arrows, until trapped. During this process, the combustion products transfer their heat to the baffle 16, causing it to heat red hot and cooling the combustion products. Upon reaching the downturned portion 96, the combustion products are trapped and directed downward to the hotter portion of the primary chamber to prolong their combustion before being discharged from the primary chamber. For optimum heat conduction, the baffle 16 is composed of a conductive material such as stainless steel.

Secondary combustion of the combustion products occurs in the secondary combustion chamber 15, which lies above the primary chamber 14 between the baffle 16 and top wall 30. The combustion products are conveyed from the primary chamber to the secondary chamber through the passage 20. While in the passage, the combustion products mix with fresh combustion air from a secondary air inlet 100 at the top of the door 38. The inlet 100 is formed between a top edge 102 of the door 38 and the front flange 42. The closed door is otherwise sealed on its sides and bottom by a batting 104 between the door and flange. The seal forces the outside air, much colder than the air within the stove, to be drawn in through inlet 100 and to sink along the glass area of the door, washing it clear for viewing the fire within. The secondary air is then drawn inward to the passage 20 and mixed with rising combustion products, as indicated by arrows in FIGS. 1 and 2.

Positioned within the chamber 15 are a plurality of upright deflective baffles 106 that delay the passage of the mixture of the combustion products and combustion air through the chamber. Preferably, the baffles 106 extend the height of the chamber 15. The combustion products pass through the chamber as indicated by the arrows in FIGS. 1 and 2 to an exhaust outlet 108 at the rear of the chamber.

Operation

The operation of the embodiment will now be described to clarify how the stove 10 works. Before lighting the stove, the operator should check through the glass area of the door 38 whether an adequate supply of fuel is present in the firebox 12. If not, fuel should be added through the door. The damper 66 is opened by pulling back on the bar 72 to permit air to enter the firebox through the draft inlet 64. The fuel may then be lit through the door 38.

The initial combustion of the fuel occurs as a portion of the combustion air is drawn from the passage 56 into the firebox 12 through the first inlets 78 and upward as shown by the arrows in FIG. 2. A portion of the air is directed through vertical conduits 82 to the horizontal conduit 76 to descend into the primary chamber 14 through the second inlet 86. The inverted baffle 16 forms a pocket in the upper region of the primary chamber to trap the combustion products and prolong their combustion.

The combustion products eventually are discharged by following gases from the primary chamber 14 into the vertical passage 20. From there, they rise slowly through the restrictive passage into the smaller secondary combustion chamber 15. As they rise, fresh combustion air from the secondary inlet 100 mixes with the combustion products within the passage. Upon entering the secondary chamber, the combustion products burn further. The remaining products, which are few in number, discharge through the exhaust outlet 108.

Second Embodiment

Figure 7:
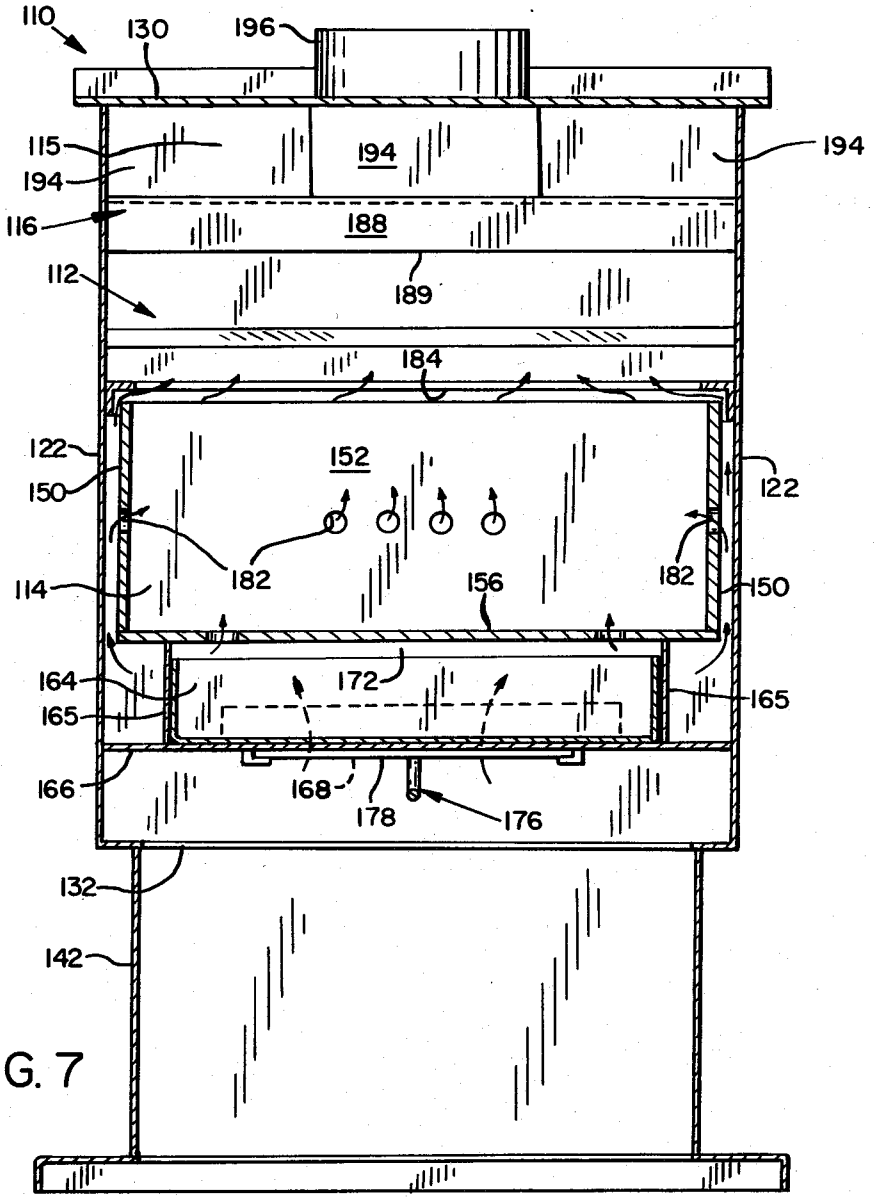
FIG. 7 is a cross-sectional view taken along line 7—7 of FIG. 6.
Figure 6:
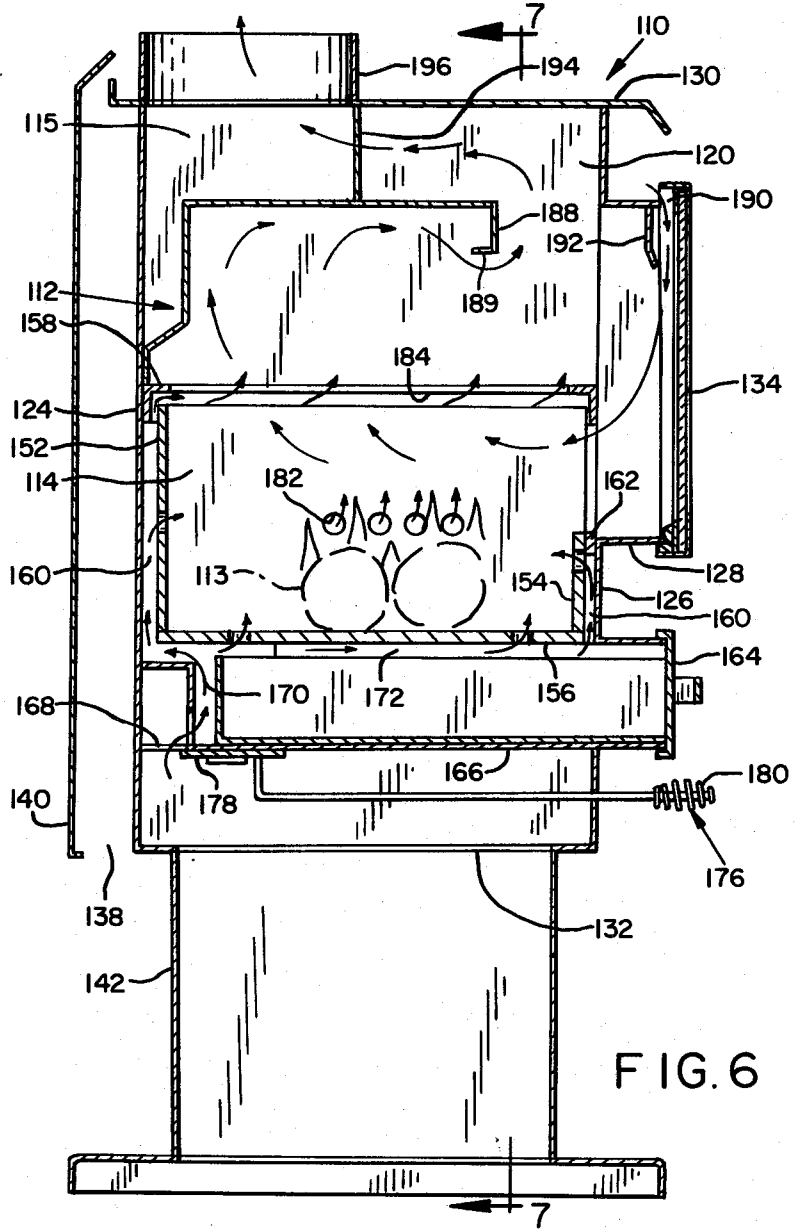
FIG. 6 is a longitudinal sectional view of a second embodiment of the stove.

A second embodiment of a low emission stove 110 appears in FIGS. 6 and 7. The second embodiment is similar to the first in may respects. As in the first embodiment, a baffle 116 divides a firebox 112 into a lower primary combustion chamber 114 and an upper secondary combustion chamber 115. Initial combustion of fuel 113 occurs in the primary chamber and secondary combustion within the secondary chamber 115. Vertical passage 120 connects the two chambers to convey combustion products from the primary chamber to the secondary chamber.

Referring to FIG. 6, stove 110 includes outer lateral, rear, and front sidewalls 122, 124, and 126 and outer top and bottom walls 130, 132. The outer front wall 126 has an opening bordered by a flange 128 and sealable by a door 134. A sleeve 138 is formed between the outer rear wall 124 and a skin 140 through which warm air is directed along the exterior of the stove for heating. The stove rests upon a stand 142 attached to the bottom wall 132.

Firebox 112 is enclosed within a central portion of the stove 110 by interior lateral, rear, and front walls 150, 152, and 154 and interior bottom wall 156 and the top wall 130. The lateral and rear walls 150, 152 are attached within the stove by their top edges to a rail 158 extending horizontally along the interior of the outer lateral and rear walls 122, 124 to space the inner walls apart from the outer walls and form a vertical air passage 160 between them. Similarly, inner front wall 154 is attached to a rail 162 extending along the interior of the front wall at the height of the flange 128 to form the vertical passage 160. Firebox 112 is thus suspended within the stove 110 with an air space between their respective sidewalls.

Below the inner bottom wall 156, an ash drawer 164 is positioned to receive ash from the firebox 112. The drawer slides within a bracket 165 upon a horizontal support plate 166. A draft inlet 168 extends through the rear of the plate 166 to supply air to a passage 170 between the inlet 168 and the bottom wall 156. The air is drawn upward through passage 170 to a horizontal passage 172 between the bottom wall and the ash drawer. Air passage 172 extends along the bottom 132 to the outer sidewalls of the stove 110 to convey the combustion air to the vertical air passage 160.

A draft inlet damper 176, also shown in FIG. 6, controls the flow of draft air from through the draft inlet 168 into the passage 170. The damper 176 includes a cover plate 178 for covering the draft inlet 168 and a handle 180 extending through the front wall 126 of the stove for controlling the damper.

The primary combustion chamber 114 is formed within the firebox below the baffle 116. Combustion air enters the chamber 114 from the passage 160 through a plurality of primary air inlets 182 located on at least one sidewall and preferably opposed or multiple sidewalls at approximately the fuel level. If the fuel is to be primarily wood, for example, the air inlets are positioned between 3 and 4 inches above the inner bottom wall 156. Air is also supplied to the chamber 114 through a second inlet 184 in the chamber's upper portion. Inlet 184 is substantially above the first inlet 182 and preferably in opposed or multiple sidewalls. However, the second inlet may be a plurality of inlets 184 located at various heights of the primary combustion chamber. The number and location of the inlets insure an adequate oxygen supply throughout the primary chamber 114.

A third air inlet 186 may also be provided in the bottom wall 132. If present, the bottom inlet also serves as an outlet for removing ash from the primary chamber into the ash drawer 164. Proportionally, approximately equal amounts of the combustion air enter the chamber 114 through each of the primary and second air inlets, with only a small portion entering through the bottom third inlet 186.

The rising combustion products produced in the primary chamber 114 are temporarily trapped by the baffle 116 within the primary chamber for further combustion. The baffle 116 includes a downturned free portion end 188 and a reverse lip portion 189 extending rearward away from the vertical passage 120. Combustion products and gases thus flow from the rear of the baffle toward the free end portion 188 and then reverse direction along the lip 189 and flow back below the baffle 116, as shown by the arrows in FIG. 6. In the process they thoroughly heat the baffle 116 and are further burned.

The combustion products eventually flow out of the primary chamber 114 and into the passage 120, where they mix with secondary combustion air from a secondary inlet 190 before entering the secondary chamber 115. The secondary inlet 190 is positioned near the vertical passage 120 between the door 134 and the flange 128. A guide 192 beneath the flange 128 directs a portion of the secondary combustion air downward to clear the glass viewing area of the door 134 and to assist in combustion within the primary combustion chamber as well. Deflective baffles 194 within the secondary chamber delay the passage of the combustion products so that they may burn with the combustion air. The products remaining are discharged through an exhaust outlet 196.

Operation

The operation of the second embodiment is similar to the first, differing in the injection of combustion air and flow of combustion products within the stove 110. Referring to FIGS. 6 and 7, the arrows indicate the flow of combustion air and combustion product through the primary chamber and the secondary chamber until discharged from the stove. By injecting combustion air on multiple sides of the primary chamber and shaping the baffle 116 to retain the combustion products temporarily, the fuel is more thoroughly burned within the chamber than in conventional stoves before it passes into the secondary chamber.

Of course, various changes and modifications of the embodiment described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A low emission fuel-burning stove comprising:

a firebox having bottom, side and top walls for initiating primary combustion of fuel placed at a fuel level within said firebox;

a baffle means dividing the firebox vertically into a large volume lower primary combustion chamber and a substantially smaller volume upper secondary combustion chamber, said baffle terminating in a downturned free end portion short of the front sidewall to define a pocket within an upper portion of the primary combustion chamber for trapping combustion products rising from the fuel and retaining them for further combustion within the primary chamber and heating the baffle to provide a heat source for secondary combustion in the secondary combustion chamber;

primary air inlet means in multiple sidewalls of the firebox at substantially the fuel level for injecting primary combustion air into the firebox at substantially fuel level;

second air inlet means in multiple sidewalls of said firebox substantially above the fuel level;

third air inlet means in the bottom of the firebox;

secondary combustion air inlet means above the second air inlet means at a fourth level within the firebox to supply air for secondary combustion within the secondary chamber;

said baffle means defining with its donwturned free end portion and a sidewall a restrictive passage connecting the primary chamber to the secondary chamber for receiving combustion products discharged from the primary chamber and conveying them to the secondary chamber.

2. The stove of claim 1 wherein the baffle means is positioned within the upper one-third of the firebox.

3. The stove of claim 1 wherein the secondary chamber includes an upright deflective baffle therein for delaying passage of the combustion products therethrough to an exhaust outlet.

4. The stove of claim 1 wherein the downturned free end portion includes a reverse lip portion extending away from the restrictive passage.

5. The stove of claim 1 wherein said baffle means has an inclined rear portion to direct the combustion products along the underside of the baffle means toward the downturned free end portion.

6. The stove of claim 1 wherein the primary air inlet means is provided in multiple sidewalls of the firebox.

7. The stove of claim 6 wherein the primary air inlet means is provided in said multiple sidewalls at fuel level.

8. The stove of claim 7 including second air inlet means substantially above the fuel level and primary air inlet means and below the baffle means to inject air into the primary chamber for continued combustion of the fuel and combustion products of said fuel.

9. The stove of claim 8 wherein said primary and second air inlet means are provided in at least two opposing sidewalls of said firebox.

10. The stove of claim 1 including secondary combustion air inlet means substantially opposite the downturned free end portion of the baffle means and adjacent the restrictive passage to supply secondary combustion air to the combustion products within the restrictive passage as said products pass from the primary chamber to the secondary chamber.

11. The stove of claim 10 whereinthe vertical restrictive passage is narrower in width than the corresponding width of the baffle means to accelerate the flow of the combustion products and secondary combustion air through the passage and thereby promoting the turbulent mixture of said products with said air to promote combustion within the secondary chamber.

12. The stove of claim 11 wherein the width of the vertical passage is no more than one-third the corresponding width of the baffle means.

13. A low emission fuel-burning stove comprising:

a firebox having bottom, side and top walls for initiating combustion of fuel at a fuel level within said firebox; and a continuous baffle means within the firebox for dividing the firebox into a lower primary combustion chamber and an upper secondary combustion chamber, said baffle means including a downturned free end portion defining a pocket in an upper portion of said primary chamber to trap combustion products and delay their passage to said secondary chamber, and further defining within one of said sidewalls a vertical restrictive passage for the combustion products from the primary chamber to the secondary chamber, the downturned free end protion including a reverse lip portion extending away from said restrictive passage to assist in retention of combustion products within the primary chamber.

14. The stove of claim 13 further including:

means defining a first air passage along the outer surface of the firebox bottom wall for receiving outside combustion air and preheating it before injecting it into the firebox;

means defining a second air passage along the outer surface of the firebox sidewalls communicating with the first passage to direct the combustion air from the first passage upward along said sidewall surfaces; and primary air inlet means in a sidewall of the firebox at substantially the fuel level for injecting the combustion air from the second passage into the firebox to promote combustion of said fuel.

15. The stove of claim 14 further including second air inlet means in a sidewall of the firebox substantially above the fuel level, the baffle means positioned above the second air inlet means.

* * * * *